US011885002B2

(12) United States Patent
Vo et al.

(10) Patent No.: US 11,885,002 B2
(45) Date of Patent: Jan. 30, 2024

(54) HIGH-PERFORMANCE 6000-SERIES ALUMINUM ALLOY STRUCTURES

(71) Applicant: NanoAL LLC, Ashland, MA (US)

(72) Inventors: Nhon Q. Vo, Winchester, MA (US); Francisco U. Flores, Lowell, MA (US); Vincent R. Jansen, Ashland, MA (US); Joseph R. Croteau, Boston, MA (US)

(73) Assignee: NanoAL LLC, Ashland, MA (US)

( * ) Notice: Subject to any disclaimer, the term of this patent is extended or adjusted under 35 U.S.C. 154(b) by 933 days.

(21) Appl. No.: 16/566,262

(22) Filed: Sep. 10, 2019

(65) Prior Publication Data

US 2020/0048749 A1 Feb. 13, 2020

Related U.S. Application Data

(63) Continuation of application No. PCT/US2018/025211, filed on Mar. 29, 2018.

(60) Provisional application No. 62/479,086, filed on Mar. 30, 2017.

(51) Int. Cl.
*C22C 21/08* (2006.01)
*C22F 1/05* (2006.01)

(52) U.S. Cl.
CPC ..... *C22F 1/05* (2013.01); *C22C 21/08* (2013.01)

(58) Field of Classification Search
None
See application file for complete search history.

(56) References Cited

U.S. PATENT DOCUMENTS

| | | | | |
|---|---|---|---|---|
| 3,551,143 | A | 12/1970 | Marukawa et al. | |
| 3,807,969 | A | 4/1974 | Schoerner et al. | |
| 5,087,301 | A | 2/1992 | Angers et al. | |
| 5,327,955 | A | 7/1994 | Easwaran | |
| 5,449,421 | A | 9/1995 | Hamajima et al. | |
| 5,776,269 | A * | 7/1998 | Farrar, Jr. | C22C 21/003 148/439 |
| 5,976,214 | A | 11/1999 | Kondoh et al. | |
| 6,149,737 | A | 11/2000 | Hattori et al. | |
| 6,592,687 | B1 | 7/2003 | Lee et al. | |
| 6,918,970 | B2 | 7/2005 | Lee et al. | |
| 8,323,373 | B2 | 12/2012 | Haynes, III et al. | |
| 8,778,099 | B2 | 7/2014 | Pandey | |
| 9,359,660 | B2 * | 6/2016 | Kamat | C22C 21/16 |
| 9,453,272 | B2 | 9/2016 | Vo et al. | |
| 2003/0192627 | A1 | 10/2003 | Lee et al. | |
| 2004/0177902 | A1 | 9/2004 | Mergen et al. | |
| 2009/0263275 | A1 | 10/2009 | Pandey | |

(Continued)

FOREIGN PATENT DOCUMENTS

| | | |
|---|---|---|
| CN | 103233147 A | 8/2013 |
| EP | 0 558 957 A2 | 9/1993 |

(Continued)

OTHER PUBLICATIONS

Non-Final Office Action dated May 4, 2016 for U.S. Appl. No. 14/645,654, 8 pages.

(Continued)

*Primary Examiner* — George Wyszomierski
*Assistant Examiner* — Janell C Morillo

(57) ABSTRACT

Aluminum-magnesium-silicon alloys, fabricated by inventive processes, that exhibit high strength, high conductivity, and high thermal stability.

11 Claims, 7 Drawing Sheets

(56) References Cited

U.S. PATENT DOCUMENTS

| | | | | |
|---|---|---|---|---|
| 2010/0143177 | A1 | 6/2010 | Pandey et al. | |
| 2011/0017359 | A1 | 1/2011 | Pandey | |
| 2012/0000578 | A1 | 1/2012 | Wang et al. | |
| 2013/0183189 | A1 | 7/2013 | Bishop et al. | |
| 2013/0199680 | A1 | 8/2013 | Apelian et al. | |
| 2013/0220497 | A1 | 8/2013 | Huskamp et al. | |
| 2015/0259773 | A1* | 9/2015 | Vo | C22C 21/02 148/415 |
| 2017/0058386 | A1 | 3/2017 | Vo et al. | |
| 2017/0175231 | A1* | 6/2017 | Shishido | C22C 21/06 |
| 2020/0017938 | A1* | 1/2020 | Kaneko | H01L 24/45 |

FOREIGN PATENT DOCUMENTS

| | | | |
|---|---|---|---|
| EP | 2 241 644 | A1 | 10/2010 |
| JP | 10-110232 | A | 4/1998 |
| KR | 10-2016-0127112 | A | 11/2016 |
| WO | WO 2005/100623 | A2 | 10/2005 |

OTHER PUBLICATIONS

Non-Final Office Action dated Dec. 31, 2018 for U.S. Appl. No. 15/263,011, 5 pages.

Final Office Action dated Aug. 8, 2019 for U.S. Appl. No. 15/263,011, 7 pages.

Extended European Search Report dated Feb. 15, 2017 for European Application No. 15760733.4, 9 pages.

Extended European Search Report dated Sep. 23, 2019 for European Application No. 19172652.0, 8 pages.

International Search Report and Written Opinion dated Jun. 25, 2016 for International Application No. PCT/US2015/020218, 14 pages.

International Search Report and Written Opinion dated Aug. 27, 2018 for International Application No. PCT/US2018/025211, 15 pages.

Berezina, A. L. et al., "Decomposition Processes in the Anomalous Supersaturated Solid Solution of Binary and Ternary Aluminum Alloys Alloyed with Sc and Zr," Acta Physica Polonica A, 122(3):539-543 (2011).

Booth-Morrison, C. et al., "Effect of Er additions on ambient and high-temperature strength of precipitation-strengthened Al—Zr—Sc—Si alloys," Acta Mater, 60:3463-3654 (2012).

Booth-Morrison, C. et al., "Role of silicon in accelerating the nucleation of $Al_3$(Sc,Zr) precipitates in dilute Al—Sc—Zr alloys," Acta Mater, 60:4740-4752 (2012).

Booth-Morrison, C. et al., "Coarsening resistance at 400° C. of precipitation-strengthened AlZrScEr Alloys," Acta Mater, 59(18):7029-7042 (2011).

Fuller, C. B. et al., "Temporal evolution of the nanostructure of Al(Sc,Zr) alloys: Part 1—Chemical compositions of $Al_3(Sc_{1-x}Zr_x)$ precipitates," Acta Mater, 53:5401-5413 (2005).

Hallem, H. et al., "The formation of $Al_3(Sc_xZryHf_{1-x-y})$ dispersoids in aluminum alloys," Mater Sci Eng A, 421:154-160 (2006).

Hori, S. et al., "Effect of small addition of Si on the precipitation of Al-0.6%Zr Alloys," J Jpn Inst Light Met, 28:79-84 (1978).

Huang, H. et al., "Age Hardening Behavior and Corresponding Microstructure of Dilute Al—Er—Zr Alloys," Metallurgical and Materials Transactions A, 44A:2849-2856 (2013).

Knipling, K. E. et al., "Criteria for developing castable, creep-resistant aluminum-based alloys—A Review," Z Metallkd, 97:246-265 (2006).

Knipling, K. E. et al., "Atom Probe Tomographic Studies of Precipitation in Al—0.1Zr—0.1Ti (at.%) Alloys," Microscopy and Microanalysis, 13:1-14 (2007).

Knipling, K. E. et al., "Nucleation and Precipitation Strengthening in Dilute Al—Ti and Al—Zr Alloys," Metallurgical and Materials Transactions A, 38A:2552-2563 (2007).

Knipling, K. E. et al., "Creep resistance of cast and aged Al—0.1Zr and Al—0.1Zr—0.1Ti (at.%) alloys at 300-400° C.," Scr Mater, 59:387-390 (2008).

Knipling, K. E. et al., "Precipitation evolution in Al—Zr and Al—Zr—Ti alloys during isothermal aging at 375-425° C.," Acta Mater, 56:114-127 (2008).

Knipling, K. E. et al., "Precipitation evolution in Al—Zr and Al—Zr—Ti alloys during isothermal aging at 450-600° C.," Acta Mater, 56:1182-1195 (2008).

Knipling, K. E. et al., "Precipitation evolution in Al—0.1Sc, Al—0.1Zr and Al—0.1Sc—0.1Zr (at.%) alloys during isochronal aging," Acta Mater, 58:5184-5195 (2010).

Knipling, K. E. et al., "Ambient- and high-temperature mechanical properties of isochronally aged Al—0.06Sc, Al—0.06Zr and Al—0.06Sc—0.06Zr (at.%) alloys," Acta Mater, 59:943-954 (2011).

LeClaire, A. D. et al., "3.2.13 Aluminum group metals," Diffusion in Solid Metals and Alloys (H. Mehrer (Ed.)), Springer Materials—Landolt-Börnstein—Group III condensed Matter, 26:151-156 (1990).

Li, H. et al., "Precipitation and evolution and coarsening resistance at 400° C. of Al microalloyed with Zr and Er," Scr Mater, 67:73-76 (2012).

Ohashi, T. et al., "Effect of Fe and Si on age hardening properties of supersaturated solid solution of Al—Zr," J Jpn. Inst Met, 34:604-640 (1970).

Riddle, Y. W. et al., "A Study of Coarsening, Recrystallization, and Morphology of Microstructure in Al—Sc—(Zr)—(Mg) Alloys," Metallurgical and Materials Transactions A, 35A:341-350 (2004).

Sato, T. et al., "Effects of Si and Ti Additions on the Nucleation and Phase Stability of the $L1_2$-Type $Al_3Zr$ Phase in Al—Zr Alloys," Mater Sci Forum, 217-222:895-900 (1996).

Seidman, D. N. et al., "Precipitation strengthening at ambient and elevated temperatures of heat-treatable Al(Sc) alloys," Acta Mater, 50:4021-4035 (2002).

Van Dalen, M. E. et al., "Effects of Ti additions on the nanostructure and creep properties of precipitation-strengthened Al—Sc alloys," Acta Mater, 53:4225-4235 (2005).

Wen, S. P. et al., "Synergetic effect of Er and Zr on the precipitation hardening of Al—Er—Zr alloy," Scr Mater, 65:592-595 (2011).

Zhang, Y. et al., "Precipitation evolution of Al—Zr—Yb alloys during isochronal aging," Scr Mater, 69:477-480 (2013).

Final Office Action dated Feb. 24, 2021 for U.S. Appl. No. 15/263,011, 7 pages.

Non-Final Office Action dated Dec. 21, 2021 for U.S. Appl. No. 15/263,011, 7 pages.

Non-Final Office Action dated Jun. 26, 2020 for U.S. Appl. No. 15/263,011, 7 pages.

Office Action dated Aug. 13, 2021 for Korean Application No. 10-2016-7028392, with English translation, 14 pages.

* cited by examiner

HIGH-PERFORMANCE 6000-SERIES ALUMINUM ALLOY STRUCTURES

This application is a continuation of International Patent Application No. PCT/US2018/025211, filed Mar. 29, 2019, and entitled High-Performance 6000-Series Aluminum Alloy Structures, which claims the benefit of and priority to U.S. Provisional Patent Application No. 62/479,086, filed Mar. 30, 2017 and entitled High-Performance 6000-Series Aluminum Alloy Structures, the contents of each of which are incorporated herein by reference in their entirety.

STATEMENT REGARDING FEDERALLY SPONSORED RESEARCH OR DEVELOPMENT

This invention was made with government support under Grant Number DE-SC0015232 awarded by the Department of Energy. The government has certain rights in this invention.

FIELD

This application relates to a family of 6000-series aluminum alloys with high strength, high electrical and thermal conductivity, and high thermal stability. The disclosed alloys are especially advantageous for, but not limited to, improving performance of aluminum conductors and connectors in high-voltage and low-voltage power transmission and distribution systems, overhead and underground cables, where a combination of high strength and electrical conductivity is important. Additionally, the disclosed alloys are also advantageous for improving performance of components in thermal management systems, such as heat exchangers and heat sinks, where a combination of high strength and thermal conductivity is important. Lastly, the disclosed alloys are, for example, advantageous for improving performance of heavy-duty structures requiring high strength and good corrosion resistance, railroad cars, storage tanks, bridges, pipes, architectural applications and automotive body panels.

BACKGROUND

Electric power transmission and distribution involves all materials and devices from a power plant to residential, commercial, government and industrial customers. During the electrical transmission, energy is lost due to the resistance of the conductors which is converted mainly to heat. Energy loss in transmission and distribution systems between 4 to 5% is considered normal, of which 2.5% is accounted for by the transmission conductors, leading to a huge cost for the economy. There is thus a significant incentive to improve efficiency in electrical energy transmission and distribution systems, for which development of advanced and high performance conductors plays a key role.

Due to a better electrical conductivity and lower cost per unit weight compared to copper, aluminum and aluminum alloys are the dominant conductors in long-distance power transmission applications, such as high-voltage overhead transmission conductors. The most popular high-voltage transmission conductor in the U.S. is an aluminum-conductor steel-reinforced (ACSR) conductor, utilizing AA1350-H19 aluminum conductors stranded around the galvanized high-strength steel core. This type of conductor has a major issue concerning thermal mismatch between aluminum and steel, causing mechanical failure such as "bird caging" and thermal fatigue during operation. Galvanic corrosion, occurring at the aluminum/steel contacts, is another major concern. An alternative to the ACSR conductor is an all-aluminum-alloy (AAAC) conductor, having only an AA6201-T81 aluminum conductor. However, AA6201-T81 has a medium tensile strength (~330 MPa) at the expense of a lower electrical conductivity (~52.5% International Annealed Copper Standard, IACS) compared to AA1350-H19 (60.9% IACS). The conductivity of AAAC is only comparable to that of the ACSR conductor; thus, it does not provide a power savings in transmission, and occupies only a small market in high-voltage power transmission.

The most common aluminum wires utilized in high-voltage power transmission applications are the 1000-series, such as the AA1350-H19, and 6000-series, specifically AA6201-T81. The ultimate tensile strength (UTS) of AA1350-H19 is relatively low (~185 MPa), while its electrical conductivity (EC) is high (60.9% IACS). The UTS of AA6201-T81 is higher (~330 MPa), while its EC is relatively low (52.5% IACS). There exists a medium grade aluminum wire between AA1350-H19 and AA6201-H81, which is AA6101-T6, having a medium UTS (~220 MPa) and a medium EC (57.7% IACS). The UTS versus EC map of several aluminum alloy series is displayed in FIG. 1. The dotted line in FIG. 1 is considered the limit of current commercial aluminum alloys in terms of obtaining both UTS and high EC.

Accordingly, high-performance 6000-series aluminum alloys that have a better combination of both strength and conductivity are needed, while maintaining important characteristics, such as density and corrosion resistance.

SUMMARY

The embodiments described herein relate to heat-treatable aluminum-magnesium-silicon-based (6000-series) alloys, fabricated by an inventive thermo-mechanical process, to form high-strength and high-conductivity aluminum wires or sheets. In some embodiments, the alloys are more heat resistant than commercial 6000-series aluminum wires or sheets under elevated temperatures.

With a higher performance material, the increased efficiency of electrical power transmission and distribution systems reduces the energy loss due to electrical conductor resistance and supplies electricity to more residential, commercial, government and industrial customers. In addition, it potentially reduces the number of towers needed for a given line distance, compared to traditional conductors. This constitutes a large financial savings, especially for long-distance high-voltage transmission lines, as the tower construction cost is about a quarter of the total cost of a new power transmission installation. The higher mechanical thermal stability of the invented aluminum alloys potentially increases the operating temperature of the transmission lines, thereby increasing their current-carrying capacity. This aids increasing the availability of electricity to end-users.

DETAILED DESCRIPTION

Figure 1:
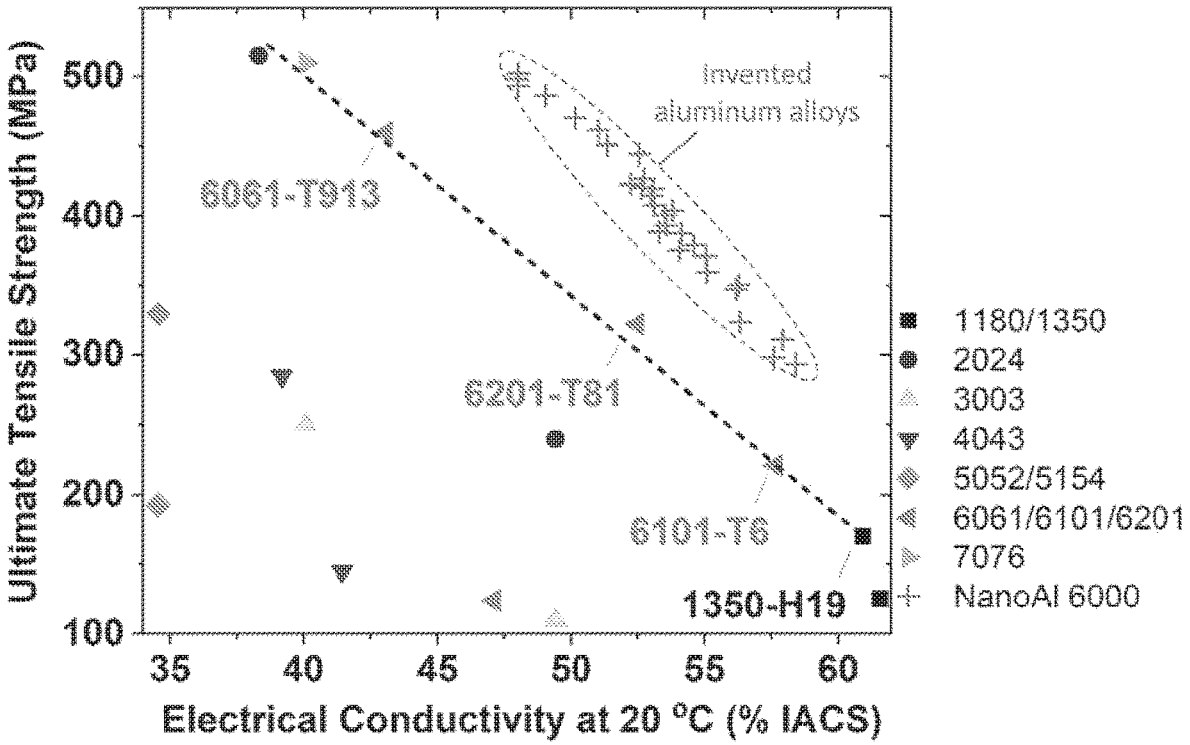
FIG. 1 is a plot of ultimate tensile strength versus electrical conductivity at 20° C. for a number of commercial aluminum alloys, including conductor-grades AA1350-H19 and AA6201-T81. The dotted black line is the limit of current commercial aluminum alloys in terms of trade-off between tensile strength and electrical conductivity. Data for the invented aluminum alloys (+) also are plotted.
Figure 2:
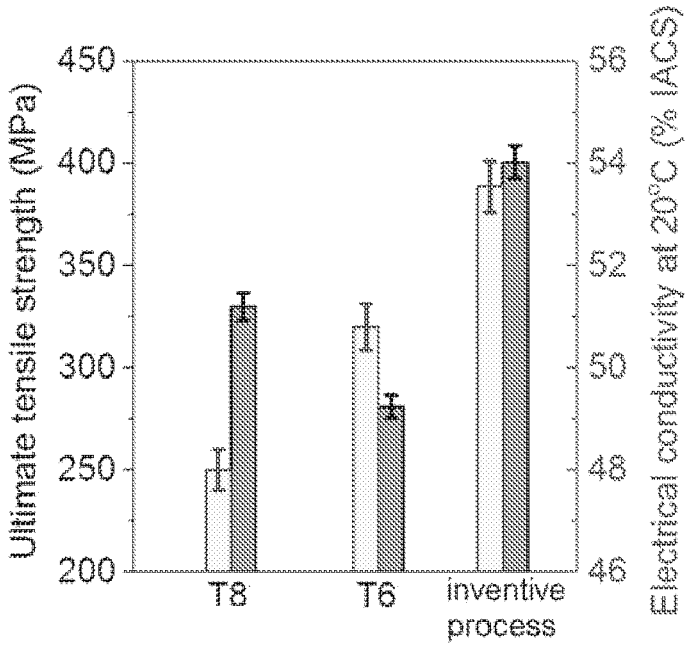
FIG. 2 displays ultimate tensile strength and electrical conductivity at 20° C. of 2.65 mm (width) square wires for the Al-0.7Mg-0.5Si alloy, which were processed by different thermo-mechanical paths.

Different thereto-mechanical processes (T8-, T6- and inventive processes) were explored to fabricate 2.65 mm (width) square wires from the base Al-0.7Mg-0.5Si wt. % (wt. % will be used hereafter unless otherwise noted) alloy. The differences among these paths are the solutionizing, peak-aging, and cold working sequences. For the T8-temper, the solutionizing is performed before the alloy is cold-worked to form wires, which was then peak-aged during the last step. For the T6-temper, the solutionizing and peak-aging steps are performed after the alloy is cold-worked to form wires. For an inventive process, the solutionizing and peak-aging steps are performed before the alloy is cold-worked to form wires. During the aging step, either before cold-working for an inventive process or after cold-working for the T8- and T6-tempers, various aging temperatures and times were studied to identify the peak-aging condition. The best combination of UTS and EC for each thermo-mechanical path is plotted in FIG. 2. The best combination of UTS and EC is defined by the data point that is highest above the dotted diagonal line in FIG. 1, representing the limit of current commercial aluminum alloys in terms of obtaining both high UTS and EC.

Figure 3A:
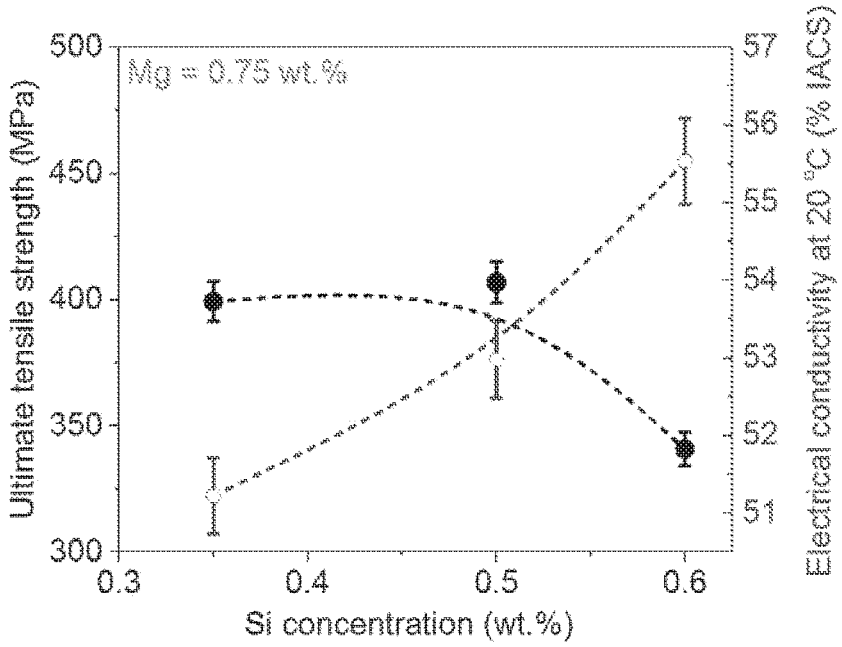
FIGS. 3A and 3B display ultimate tensile strength and electrical conductivity at 20° C. of the 2.65 mm (width) square wires as a function, respectively, of: (a) Si concentration in the Al-0.75Mg—Si-0.003Sr alloy; and (b) Mg concentration in the Al—Mg-(0.5-0.55)Si-0.003Sr wt. % alloy, peak-aged at 200° C. for 24 h, before cold-rolling.
Figure 3B:
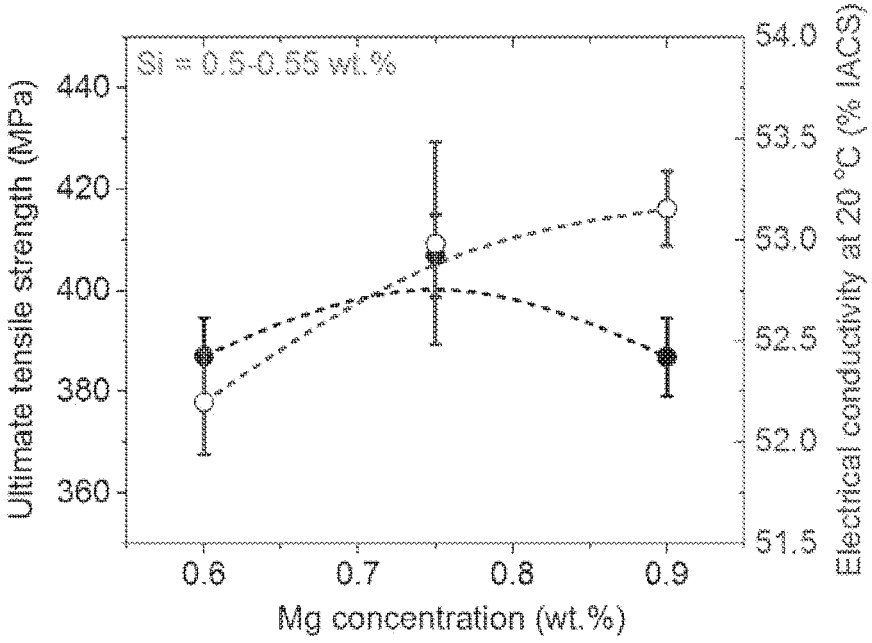

Optimized Mg and Si concentrations in the 6000-series aluminum wire, processed by inventive processes, to obtain the optimized combination of UTS and EC were identified. Various Si concentrations in the Al-0.75Mg—Si-0.003Sr alloy, FIG. 3A, and various Mg concentrations in the Al—Mg-(0.5-0.55)Si-0.003Sr alloy, FIG. 3B, peak-aged at 200° C. for 24 h before cold-rolling to 2.65 mm (width) square wires, were investigated as a function of the UTS and EC values of the wires. With a Mg concentration of 0.75%, electrical conductivity increases as a function of Si concentration. The UTS, however, peaks at ~0.5% Si and rapidly decreases at higher Si concentrations.

With a Si concentration of 0.5-0.55%, the electrical conductivity increases with an increase in Mg concentration. The UTS, however, peaks at ~0.75% Mg and decreases at higher values. The higher the Mg concentration is, the higher is the volume fraction of the $\beta$-$Mg_2Si$ phase, thus decreasing the Si solutes remaining in the $\alpha$-Al matrix. In turn, this leads to a higher EC value. It is noted, though, that with a Mg concentration>0.9%, the workability of the wire is decreased; surface cracks were observed in the rolled wires. Thus, the smaller value of the UTS may be due to cracks present after the cold-working. In conclusion, we find that a Si concentration of ~0.45-0.55 wt. % and a Mg concentration of ~0.7-0.8 wt. % is optimal for obtaining the best combination of UTS and EC values in 6000-series aluminum wires, utilizing the inventive process.

Figure 4:
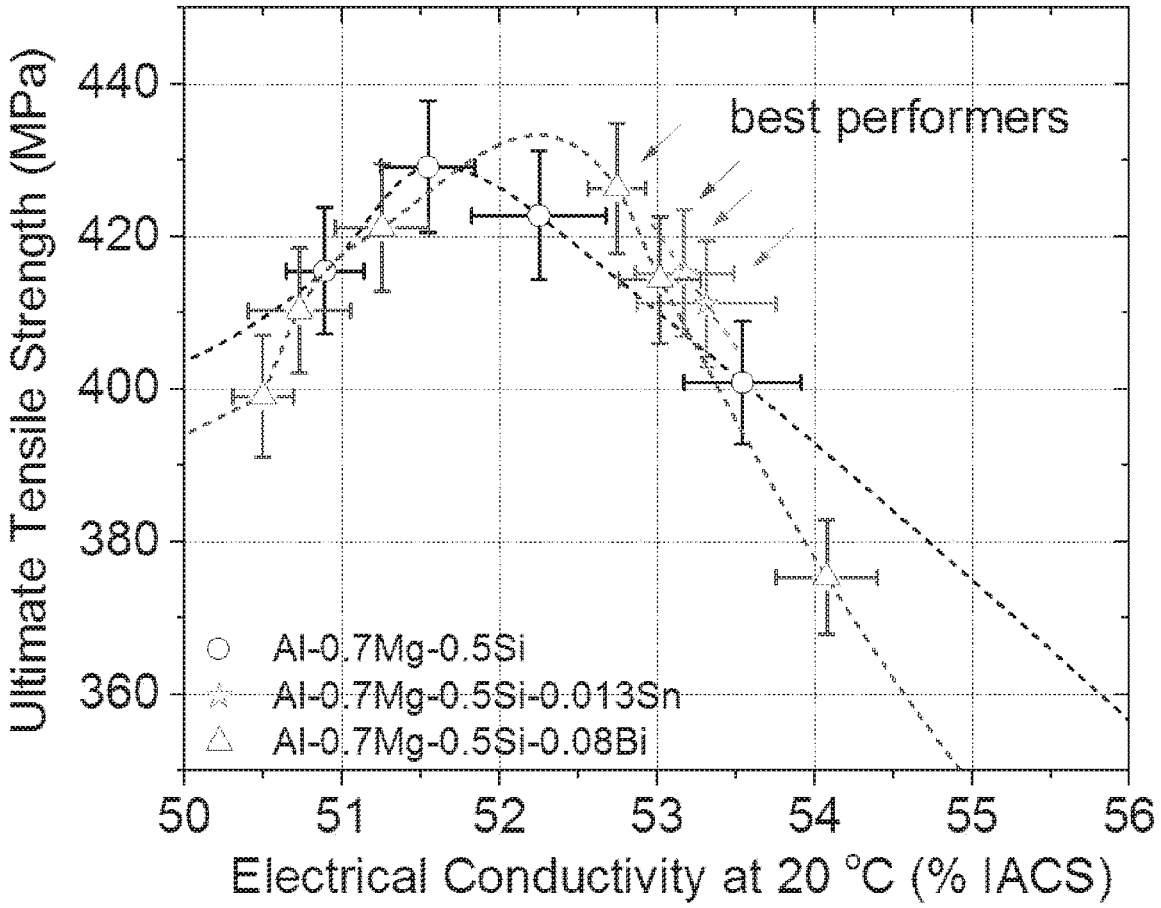
FIG. 4 is a map of ultimate tensile strength and electrical conductivity at 20° C. for investigated 2.65 mm (width) square wires, employing Al-0.7Mg-0.5Si with additions of 0.013% Sn and 0.08% Bi, processed by an invented thermo-mechanical process.

We investigated the effects of different inoculants (Sn and Bi) in the optimized Al-0.7Mg-0.5Si wire, processed by an optimized processing route (inventive process). The concentrations of the inoculants were chosen based on their maximum solid solubilities in binary phase diagrams with Al. With addition of inoculants, the wires, Al-0.7Mg-0.5Si-0.08Bi aged at 200° C. for 7 h and Al-0.7Mg-0.5Si-0.013Sn aged at 200° C. for 16 and 24 h, before cold-rolling to the final size, appear to have better combinations of UTS and EC, compared to the inoculant-free Wire, FIG. 4. In conclusion, we find that inoculants further optimize UTS/EC of the Al—Mg—Si-based alloys.

Additionally, we found that an addition of 0.003% Sr helps reducing the peak-aging time in the optimized Al-0.7Mg-0.5Si wire, processed by an optimized processing route (inventive process). The peak-aging time reduces from 7 h to 4 h at 200° C., with the addition of Sr.

Figure 5:
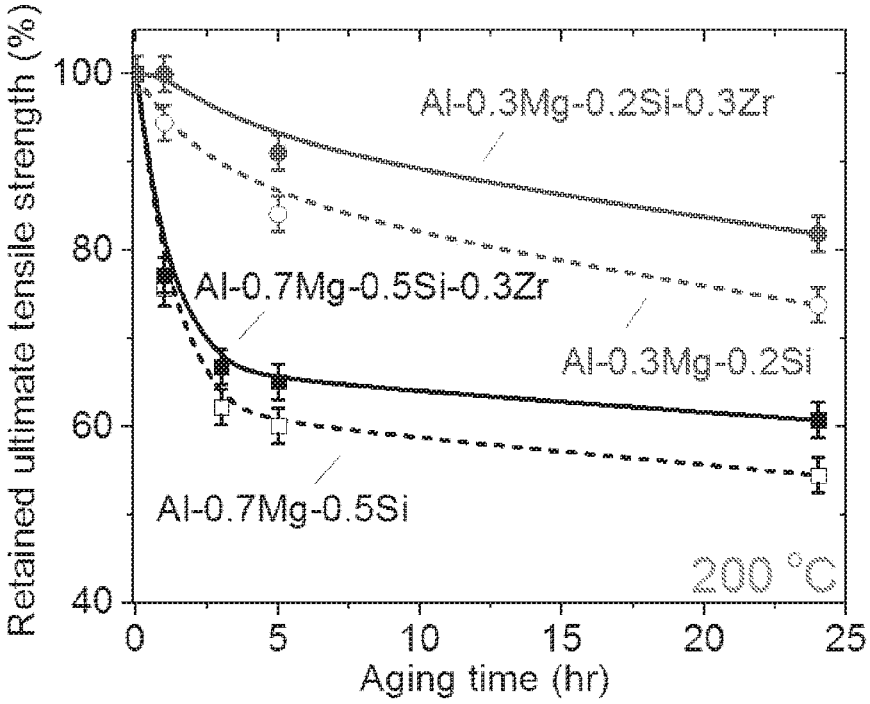
FIG. 5 displays retained ultimate tensile strength of the Al-0.7Mg-0.5Si and Al-0.7Mg-0.5Si-0.3Zr 1.5 mm (width) square wires, and Al-0.3Mg-0.2Si and Al-0.3Mg-0.2Si-0.3Zr 2.65 mm (width) square wires as a function of aging time at 200° C.

We demonstrated that an addition of 0.3% Zr improves heat resistance of the based Al-0.7Mg-0.5Si and Al-0.3Mg-0.2Si alloys. Wire samples were fabricated utilizing an inventive process (solutionzing at 530° C. for 2 h, peak-aging at 200° C. for 7 h, then cold-working for Al-0.7Mg-0.5Si-based alloys and solutionzing at 450° C. for 4 h, peak-aging at 190° C. for 8 h, then cold-working for Al-0.3Mg-0.2Si-based alloys). UTS of the Al—Mg—Si wires is maintained the same, while EC decreases ~2% IACS, with the 0.3% Zr addition. FIG. 5 displays the retained UTS of Al-0.7Mg-0.5Si and Al-0.3Mg-0.2Si wires with 0.3% Zr addition, after exposure at 200° C. for up to 24 h, compared to the based Al—Mg—Si wires. After 24 h, retained UTS of Al-0.7Mg-0.5Si-0.3Zr is ~61%, while that of Al-0.7Mg-0.5Si is ~54%, showing an improvement of 7% with Zr addition. After the same exposure time, retained UTS of Al-0.3Mg-0.2Si-0.3Zr is ~82%, while that of Al-0.3Mg-0.2Si is ~74%, showing an improvement of 8% with Zr addition.

Figure 6:
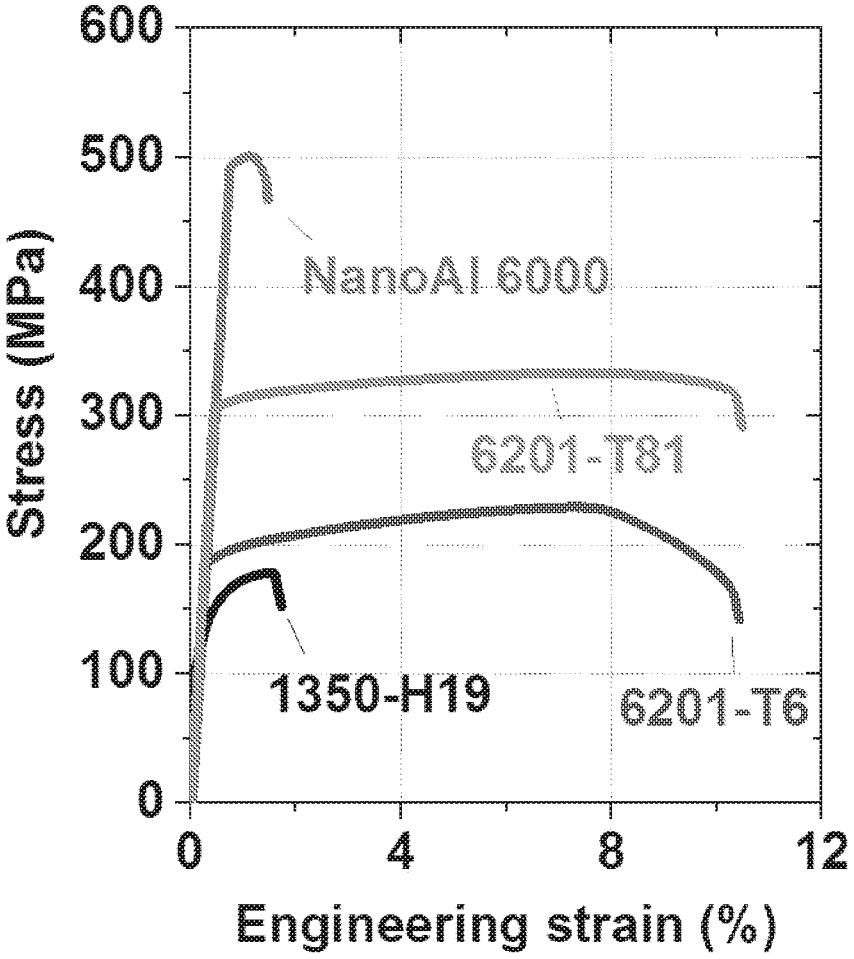
FIG. 6 displays a stress vs. strain plot for an invented aluminum wire (NanoAl 6000), as compared to commercial AA1350-H19, AA6201-T6, and AA6201-T81 conductor wires.
Figure 7:
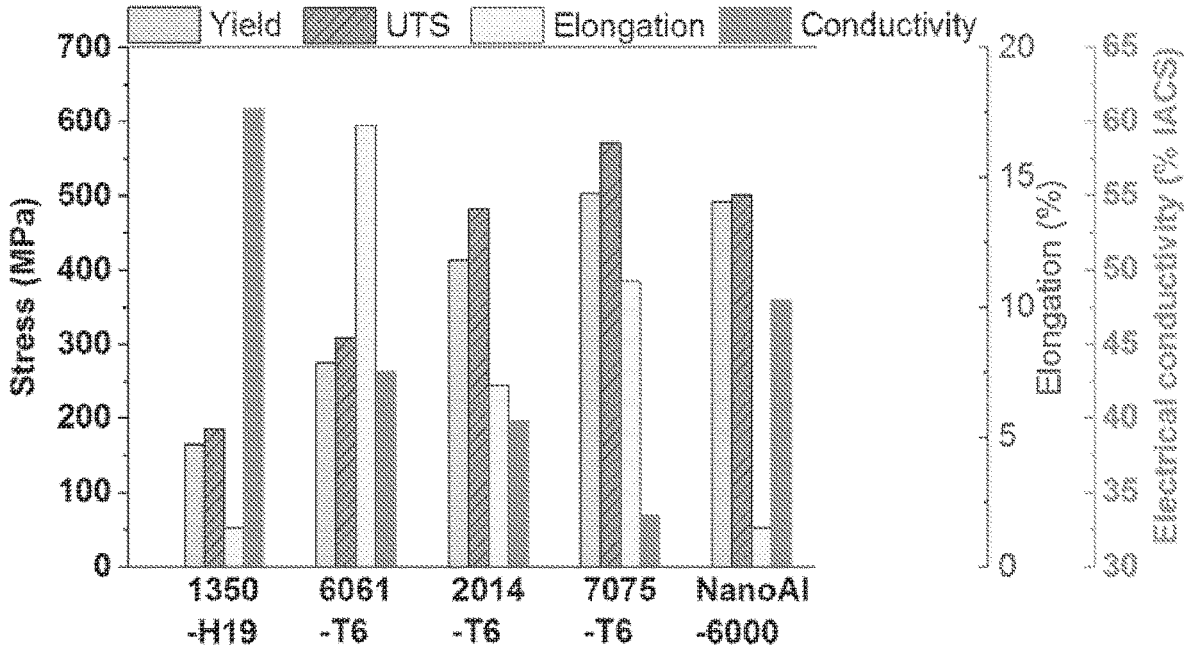
FIG. 7 displays yield strength, Ultimate tensile strength, elongation and electrical conductivity of an invented aluminum wire (NanoAl-6000) aluminum wire, compared to an AA1350-H19 conductor and common commercial high-strength aluminum alloys.

FIG. 6 displays the strength of an inventive aluminum wire (NanoAl 6000) to other commercial aluminum wires. Strength of an inventive wire reaches nearly 500 MPa, while the highest strength of other aluminum conductor wire is only about 330 MPa. Property comparisons between an inventive aluminum wire (NanoAl-6000) and other commercial high-strength aluminum alloys are displayed in FIG. 7. It is striking that the obtained strength from an inventive wire is comparable to the high-strength aerospace graded 2000- and 7000-series aluminum alloys. The obtained specific strength of an inventive aluminum wire is also comparable to that of galvanized high-strength steel, which is used as the reinforcing core of electrical conductors in overhead power lines. Thus, our new high-strength, high-conductivity aluminum wire can replace the steel core, drastically boosting the overhead conductor's electrical conductivity, as electrical conductivity of the steel core is very low (<10% IACS).

In aluminum alloys, electrical conductivity is proportional to thermal conductivity. Thus, an aluminum alloy that has a high electrical conductivity will most likely have a high thermal conductivity. Thereby the inventive aluminum wires and sheets are anticipated to also have a combination of high strength and thermal conductivity.

In some disclosed embodiments, a fabricated aluminum alloy structure made from an aluminum alloy comprising aluminum, magnesium and silicon has a high electrical conductivity value EC of at least about 47.5% IACS, and has a high tensile strength value of at least [960 MPa−(11 MPa/% IACS)(EC % IACS)]. The equation for the tensile strength value is derived from FIG. 1.

In some disclosed embodiments, the aluminum alloy structure comprises about 0.6% to about 0.9% by weight magnesium, and about 0.35% to about 0.7% by weight silicon, with aluminum as the remainder. In some disclosed embodiments, the aluminum alloy structure comprises about 0.6% to about 0.9% by weight magnesium, about 0.35% to about 0.7% by weight silicon, and about 0.005% to about 0.2% by weight tin, with aluminum as the remainder. In some disclosed embodiments, the aluminum alloy structure comprises about 0.6% to about 0.9% by weight magnesium, about 0.35% to about 0.7% by weight silicon, and about 0.005% to about 0.2% by weight bismuth, with aluminum as the remainder. In some disclosed embodiments, the aluminum alloy structure comprises about 0.6% to about 0.9% by weight magnesium, about 0.35% to about 0.7% by weight silicon, and about 0.001% to about 0.01% by weight strontium, with aluminum as the remainder. In some disclosed embodiments, the aluminum alloy structure comprises about 0.6% to about 0.9% by weight magnesium, about 0.35% to about 0.7% by weight silicon, and about 0.1% to about 0.5% by weight zirconium, with aluminum as the remainder. In some disclosed embodiments, the aluminum alloy structure comprises no more than about 0.1% by weight copper as an impurity, and no more than about 0.5% by weight iron as an impurity.

In some disclosed embodiments, the aluminum alloy structure is fabricated by a method comprising: a) melting the aluminum, while adding master alloys, at a temperature about 700° C. to about 900° C., b) then Casting the melted constituents into casting molds at ambient temperature, c) then solutionizing the casted ingot at a temperature about 500° C. to about 580° C. for a time of about 0.2 to about 6 hours, d) then heat aging the solutionized ingot at a temperature about 180° C. to about 235° C. for a time of about 0.5 to about 48 hours, and e) then cold-rolling the aged ingot at ambient temperature with an area reduction from about 1000% to about 8000%. In some disclosed embodiments, the method further comprises annealing the cold-rolled structure at a temperature of about 150° C. to about 225° C. for a time of about 0.5 hours to about 48 hours.

In some disclosed embodiments, the aluminum alloy structure has high tensile strength from about 290 MPa to about 500 MPa. In some disclosed embodiments, the aluminum alloy structure has high electrical conductivity from about 47.5 to about 58.5% MACS. In some disclosed embodiments, the aluminum alloy structure comprising zirconium possesses a higher heat resistance, compared to the zirconium-free 6000-series aluminum alloys. In some disclosed embodiments, mechanical strength of the aluminum alloy structure is comparable to that of the commercial high-strength 2000- and 7000-series aluminum alloys. In some disclosed embodiments, specific strength of the aluminum alloy structure is comparable to that of galvanized high-strength steel, which is used as the reinforcing core of electrical conductors in overhead power lines. In some disclosed embodiments, the aluminum alloy structure can replace the steel core in an aluminum-conductor steel-reinforced (ACSR) conductor, drastically boosting the overhead conductor's electrical conductivity. In some disclosed embodiments, the aluminum alloy structure can replace the AA6201-T81 conductor in all-aluminum-alloy (AAAC) conductor, drastically boosting the overhead conductor's strength and electrical conductivity.

Wrought aluminum alloys of the Al—Mg—Si-based 6000 series are among the most commonly produced aluminum alloys. These alloys are formable, weldable, heat treatable, and have good corrosion resistance. AA6061 and AA6063 are two of the top five most produced aluminum alloys. AA6061 sheet, extrusions, and forgings are commonly used in vehicle construction, sporting equipment, and household items. AA6063 extrusions are widely used in architectural and construction applications, such as door and window casings. A significant commercial opportunity is identified to produce 6000-series aluminum alloy extrusions to be used in battery casings for hybrid and electric vehicles. For this application, it is desired to couple the high strength of AA6061 with the high thermal conductivity of AA6063. These extrusions necessarily will be used in the T6 temper; i.e., they will be solutionized and then artificially aged. Thus we investigated the effect of $Al_3Zr$ nano-precipitations to an Al—Mg—Si based alloy. About 0.4 wt. % Zr and about 0.08 wt. % Sn were added to an Al-0.67Mg-0.6Si alloy. A combination of Zr and Sn was shown to form a high number density of nanoscale $Al_3Zr$ nano-precipitations, which increases strength while having an insignificant negative effect on conductivity. This behavior is described in U.S. Pat. No. 9,453,272, which is incorporated herein by reference. Chemical compositions and physical properties of AA6061 (example alloy 1), AA6063 (example alloy 2), and invented alloy 3 are given in Table 1. All alloys are in the T6 condition and thin sheet. The thermal conductivity of the invented alloy 3 is estimated based on its electrical conductivity. In this work, it was demonstrated that an alloy can be achieved with the strength of AA6061-T6, the thermal conductivity of AA6063-T6, and with a good ductility.

TABLE 1

| Alloy | | [Mg] wt. % | [Si] wt. % | [Cu] wt. % | [Cr] wt. % | [Fe] wt. % | [Zr] wt. % | [Sn] wt. % | Thermal Cond. (W/mK) | Yield Stress (MPa) | Ultimate Stress (MPa) | Elong. (%) |
|---|---|---|---|---|---|---|---|---|---|---|---|---|
| AA6061 | Min: | 0.80 | 0.40 | 0.15 | 0.04 | — | — | — | 167 | 276 | 310 | 12 |
| (example alloy 1) | Max: | 1.20 | 0.80 | 0.40 | 0.35 | 0.7 | 0.05 | 0.05 | | | | |
| AA6063 | Min: | 0.45 | 0.20 | — | — | — | — | — | 200 | 214 | 241 | 12 |
| (example alloy 2) | Max: | 0.90 | 0.60 | 0.10 | 0.10 | 0.35 | 0.05 | 0.05 | | | | |
| Invented alloy 3 | | 0.67 | 0.6 | 0.01 | 0.00 | 0.01 | 0.41 | 0.08 | ~190 | 285 | 297 | 8 |

6000 series aluminum alloys are prone to natural aging; i.e. precipitation of the strengthening Mg—Si phase occurs at room temperature. Natural aging begins immediately after the alloy is cast or quenched from a solufionizing heat treatment. However, this natural aging is detrimental to the strength of the alloy and, after natural aging has occurred, the alloy cannot be artificially aged to the same peak strength as if the natural aging had not occurred. These detrimental effects are apparent within minutes and are fully realized within only a few hours. In industrial production though, natural aging is unavoidable because it is impractical to begin to peak age immediately upon quenching. It often takes days, and up to weeks, before the solutionized material can be aged. The addition of ~0.1 wt. % Sn to Al—Mg—Si alloys has been shown to delay natural aging from occurring for up to ~4 weeks. It is believed that this is because Sn has a strong affinity for vacancies in aluminum alloys, and vacancies, which normally nucleate $Mg_2Si$, are bound to Sn atoms. However, Sn has virtually no solubility in solid aluminum and, after aging, Sn segregates to grain boundaries and embrittles the alloy. We have developed a concept which takes advantage of the benefits of Sn in aluminum alloys while neutralizing its embrittling effect. To do so, we have studied an Al-0.8Mg-0.6Si wt. % alloy with additions of Sn, Fe and Sn, and Zr and Sn. We believe that Sn diffuses to Al—Fe or Al—Zr intermetallics instead of grains boundaries so that the alloy is not embrittled after aging. We have investigated alloys with compositions given in Table 2 in T6, T8, T9, and a modified T8 temper. Specific steps of these tempers are:

T6: cast at 900° C.→cold roll→solutionize (550° C./1 hr)→age (180° C./6 hr)

T8: cast at 900° C.→solutionize (550° C./1 hr)→cold roll age (100° C./48 hr)

Modified T8: cast at 900° C.→solutionize (550° C./1 hr)→age (180° C./2 hr)→cold roll→age (100° C./48 hr)

T9: cast at 900° C.→solutionize (550° C./1 hr)→age (180° C./6 hr)→cold roll

Alloys with Zr/Sn were aged at 445° C. for 5 hours prior to solutionizing. Table 2 shows the chemical compositions and mechanical properties of Al—Mg—Si alloys with additions of Sn, Fe and Sn, and Zr and Sn in the different tempers.

TABLE 2

| Alloy | [Mg] wt. % | [Si] wt. % | [Fe] wt. % | [Zr] wt. % | [Sn] wt. % | Property | Temper T6 | T8 | Modified T8 | T9 |
|---|---|---|---|---|---|---|---|---|---|---|
| Control (example alloy 1) | 0.8 | 0.6 | 0.2 | 0.001 | 0.007 | Yield (MPa) | 210 | 305 | 350 | 400 |
| | | | | | | UTS (MPa) | 247 | 331 | 372 | 409 |
| | | | | | | Elong. (%) | 11 | 7 | 5.5 | 0.5 |
| +Sn (example alloy 2) | 0.86 | 0.68 | 0.03 | 0.00 | 0.10 | Yield (MPa) | 260 | 360 | 400 | — |
| | | | | | | UTS (MPa) | 268 | 385 | 411 | — |
| | | | | | | Elong. (%) | 1 | 6 | 1.5 | — |
| +Fe/Sn (invented alloy 3) | 0.70 | 0.59 | 0.18 | 0.00 | 0.09 | Yield (MPa) | 255 | 345 | 405 | 450 |
| | | | | | | UTS (MPa) | 284 | 366 | 414 | 455 |
| | | | | | | Elong. (%) | 6.5 | 6 | 3 | 0.5 |
| +Zr/Sn (invented alloy 4) | 0.86 | 0.54 | 0.01 | 0.40 | 0.11 | Yield (MPa) | 275 | 350 | 410 | 430 |
| | | | | | | UTS (MPa) | 291 | 369 | 429 | 440 |
| | | | | | | Elong. (%) | 9 | 6.5 | 4 | 0.5 |

It was found that Sn does indeed embrittle the alloys, so much so that the T9 temper was impossible to produce in the Al—Mg—Si alloy with an addition of Sn alone. The embrittling effect of Sn is most obvious in the T6 condition. Although the additions of Fe and Sn, and Zr and Sn, were shown to improve the strength of the alloy in the T6 condition, it is possible for the control alloy to reach a similar combination of strength and ductility through an alternate processing route. However, in the other three tempers, the modified alloys showed a significant increase in strength without sacrificing ductility. It is believed that the reason for this in the alloy with Fe/Sn is that Sn refines the Mg—Si phase so that there is a higher number density of finer precipitates, and the Fe is believed to trap the Sn at the interfaces of intermetallic phases rather than at grain boundaries. In the alloys with Zr/Sn, and with an additional aging step prior to solutionizing, $Al_3Zr$ nanoprecipitates increase strength. In the modified T8 temper, fine precipitates are formed during the first aging step. These precipitates are believed to form dislocation entanglements during the subsequent cold working, which remain stable during the secondary aging and add to the strength.

In some disclosed embodiments, a fabricated aluminum alloy structure comprises about 0.6% to about 0.9% by weight magnesium, about 0.35% to about 0.7% by weight silicon, about 0.2% to about 0.5% by weight zirconium, and about 0.005% to about 0.2% by weight tin, with aluminum as the remainder; and comprises $Al_3Zr$ nanoscale precipitates having an average diameter of no more than about 20 nm, having an $L1_2$ structure in an α-Al face centered cubic matrix, and having an average number density of at least about $20^{21}$ $m^{-3}$; where the aluminum alloy structure has a thermal conductivity of at least about 185 W/mK, a yield strength of at least about 270 MPa, and a tensile strength of at least about 290 MPa. In some disclosed embodiments, the aluminum alloy structure comprises about 0.4% by weight zirconium and about 0.1% by weight tin. In some disclosed embodiments, the aluminum alloy structure comprises no more than about 0.1% by weight copper as an impurity, and no more than about 0.5% by weight iron as an impurity.

In some disclosed embodiments, a fabricated aluminum alloy structure comprises about 0.6% to about 0.9% by weight magnesium, about 0.35% to about 0.7% by weight silicon, about 0.2% to about 0.5% by weight zirconium, and about 0.005% to about 0.2% by weight tin, with aluminum as the remainder; and comprises $Al_3Zr$ nanoscale precipitates having an average diameter of no more than about 20 nm, having an $L1_2$ structure in an α-Al face centered cubic matrix, and having an average number density of at least about $20^{21}$ $m^{-3}$; where the aluminum alloy structure has a yield strength of at least about 400 MPa, a tensile strength of at least about 420 MPa, and an elongation at break of at least about 3%. In some disclosed embodiments, the aluminum alloy structure comprises about 0.4% by weight zirconium and about 0.1% by weight tin. In some disclosed embodiments, the aluminum alloy structure comprises no more than about 0.1% by weight copper as an impurity, and no more than about 0.5% by Weight iron as an impurity.

In some disclosed embodiments, a fabricated aluminum alloy structure comprises about 0.6% to about 0.9% by weight magnesium, about 0.35% to about 0.7% by weight silicon, about 0.2% to about 0.5% by weight zirconium, and about 0.005% to about 0.2% by weight tin, with aluminum as the remainder; and comprises $Al_3Zr$ nanoscale precipitates having an average diameter of no more than about 20 nm, having an $L1_2$ structure in an α-Al face centered cubic matrix, and having an average number density of at least about $20^{21}$ $m^{-3}$; Where the aluminum alloy structure has a yield strength of at least about 270 MPa, a tensile strength of at least about 290 MPa, and an elongation at break of at least about 8%. In some disclosed embodiments, the aluminum alloy structure comprises about 0.4% by weight zirconium and about 0.1% by weight tin. In some disclosed embodiments, the aluminum alloy structure comprises no more than about 0.1% by weight copper as an impurity, and no more than about 0.5% by weight iron as an impurity.

In some disclosed embodiments, a fabricated aluminum alloy structure comprises about 0.6% to about 0.9% by weight magnesium, about 0.35% to about 0.7% by weight silicon, about 0.2% by weight iron, and about 0.1% weight tin, with aluminum as the remainder; where the aluminum alloy structure has a yield strength of at least about 400 MPa, a tensile strength of at least about 410 MPa, and an elongation at break of at least about 2%.

In some disclosed embodiments, the aluminum alloy structure is fabricated by a method comprising: a) melting aluminum, while adding master alloys, at a temperature of about 700° C. to about 900° C.; b) then casting the melted constituents into a casting mold at ambient temperature; c) then cold-rolling the casted ingot; d) then heat aging the rolled structure at a temperature about 350° C. to about 460° C. for a time of about 0.5 hours to about 8 hours; e) then solutionizing the aged structure at a temperature of about 500° C. to about 580° C. for a time of about 0.2 hours to about 6 hours; and f) then heat aging the solutionized structure at a temperature about 100° C. to about 200° C. for a time of about 0.5 hours to about 48 hours. In some disclosed embodiments, the fabricated aluminum alloy structure comprises about 0.6% to about 0.9% by weight magnesium, about 0.35% to about 0.7% by weight silicon, about 0.4% by weight zirconium, and about 0.1% by weight tin. In some disclosed embodiments, the fabricated aluminum alloy structure has a thermal conductivity of at least about 185 W/mK, a yield strength of at least about 270 MPa, and a tensile strength of at least about 290 MPa. In some disclosed embodiments, the fabricated aluminum alloy structure has a yield strength of at least about 270 MPa, a tensile strength of at least about 290 MPa, and an elongation at break of at least about 8%.

In some disclosed embodiments, the aluminum alloy structure is fabricated by a method comprising: a) melting aluminum, while adding master alloys, at a temperature of about 700° C. to about 900° C.; b) then casting the melted constituents into a casting mold at ambient temperature; c) then heat aging the casted ingot at a temperature of about 350° C. to about 460° C. for a time of about 0.5 hours to about 8 hours; d) then solutionizing the aged structure at a temperature of about 500° C. to about 580° C. for a time of about 0.2 hours to about 6 hours; e) then heat aging the solutionized structure at a temperature about 160° C. to about 220° C. for a time of about 0.2 hours to about 6 hours; 0 then cold-rolling the aged structure; and g) then heat aging the rolled structure at a temperature about 80° C. to about 120° C. for a time of about 24 hours to about 100 hours. In some disclosed embodiments, the fabricated aluminum alloy structure comprises about 0.6% to about 0.9% by weight magnesium, about 0.35% to about 0.7% by weight silicon, about 0.4% by weight zirconium, and about 0.1% by weight tin, with aluminum as the remainder. In some disclosed embodiments, the fabricated aluminum alloy structure has a yield strength of at least about 400 MPa, a tensile strength of at least about 420 MPa, and an elongation at break of at least about 3%.

A fabricated form of the disclosed aluminum alloy structures may, for example, be wires, sheets or plates. Examples of applications include an electrical conductor or connector such as, for example, electrical conductors or connectors used in high-voltage or in low-voltage power transmission and distribution systems, or as overhead or underground cables. Other examples of applications include thermal conductors such as, for example, thermal conductors used in components in thermal management systems, such as heat exchangers or heat sinks. Other examples of applications include components such as, for example, heavy-duty structures requiring high strength and good corrosion resistance, railroad car components, storage tanks, bridge components, pipes, architectural application components, automotive body panels, and so forth.

From the foregoing, it will be understood that numerous modifications and variations can be effectuated without departing from the true spirit and scope of the novel concepts of the present invention. It is to be understood that no limitation 14 with respect to the specific embodiments illustrated and described is intended or should be inferred.

The invention claimed is:

1. An aluminum alloy structure, comprising:

0.6% to 0.9% by weight magnesium, 0.35% to 0.7% by weight silicon, 0.2% to 0.5% by weight zirconium, and 0.005% to 0.2% by weight tin, with aluminum as the remainder; and $Al_3Zr$ nanoscale precipitates having an average diameter of no more than 20 nm, having an $L1_2$ structure in an α-Al face centered cubic matrix, and having an average number density of at least $10^{21}$ $m^{-3}$;

wherein the aluminum alloy structure has a thermal conductivity of at least 185 W/mK, a yield strength of at least 270 MPa, and a tensile strength of at least 290 MPa.

2. The aluminum alloy structure of claim 1, wherein the aluminum alloy structure comprises 0.4% by weight zirconium and 0.1% by weight tin.

3. The aluminum alloy structure of claim 1, wherein the aluminum alloy structure comprises no more than 0.1% by weight copper as an impurity, and no more than 0.5% by weight iron as an impurity.

4. The aluminum alloy structure of claim 1, wherein the aluminum alloy structure comprises 0.67% by weight magnesium, 0.6% by weight silicon, 0.41% by weight zirconium, and 0.08% by weight tin, with aluminum as the remainder.

5. An aluminum alloy structure, comprising:

0.6% to 0.9% by weight magnesium, 0.35% to 0.7% by weight silicon, 0.2% to 0.5% by weight zirconium, and 0.005% to 0.2% by weight tin, with aluminum as the remainder; and $Al_3Zr$ nanoscale precipitates having an average diameter of no more than 20 nm, having an $L1_2$ structure in an α-Al face centered cubic matrix, and having an average number density of at least $10^{21}$ $m^{-3}$;

wherein the aluminum alloy structure has a yield strength of at least 400 MPa, a tensile strength of at least 420 MPa, and an elongation at break of at least 3%.

6. The aluminum alloy structure of claim 5, wherein the aluminum alloy structure comprises 0.4% by weight zirconium and 0.1% by weight tin.

7. The aluminum alloy structure of claim 5, wherein the aluminum alloy structure comprises no more than 0.1% by weight copper as an impurity, and no more than 0.5% by weight iron as an impurity.

8. The aluminum alloy structure of claim 5, wherein the aluminum alloy structure comprises 0.86% by weight magnesium, 0.54% by weight silicon, 0.4% by weight zirconium, and 0.11% by weight tin, with aluminum as the remainder.

9. An aluminum alloy structure, comprising:

0.6% to 0.9% by weight magnesium, 0.35% to 0.7% by weight silicon, 0.2% to 0.5% by weight zirconium, and 0.005% to 0.2% by weight tin, with aluminum as the remainder; and $Al_3Zr$ nanoscale precipitates having an average diameter of no more than 20 nm, having an $L1_2$ structure in an α-Al face centered cubic matrix, and having an average number density of at least $10^{21}$ $m^{-3}$;

wherein the aluminum alloy structure has a yield strength of at least 270 MPa, a tensile strength of at least 290 MPa, and an elongation at break of at least 8%.

10. The aluminum alloy structure of claim 9, wherein the aluminum alloy structure comprises 0.4% by weight zirconium and 0.1% by weight tin.

11. The aluminum alloy structure of claim 9, wherein the aluminum alloy structure comprises no more than 0.1% by weight copper as an impurity, and no more than 0.5% by weight iron as an impurity.

* * * * *